US007810263B2

(12) United States Patent
Demaurex

(10) Patent No.: US 7,810,263 B2
(45) Date of Patent: Oct. 12, 2010

(54) BACK-LIGHTED PRISMATIC MODULE PRICE DISPLAY SYSTEM

(75) Inventor: Louis Demaurex, Lausanne (CH)

(73) Assignee: Lansa SA, Ecublens (CH)

( * ) Notice: Subject to any disclaimer, the term of this patent is extended or adjusted under 35 U.S.C. 154(b) by 301 days.

(21) Appl. No.: 11/676,556

(22) Filed: Feb. 20, 2007

(65) Prior Publication Data

US 2007/0220795 A1 Sep. 27, 2007

Related U.S. Application Data

(60) Provisional application No. 60/743,781, filed on Mar. 26, 2006.

(51) Int. Cl.
*G09F 13/00* (2006.01)

(52) U.S. Cl. ..... 40/561; 40/605

(58) Field of Classification Search ..... 40/605, 40/561; 349/63; 362/603

See application file for complete search history.

(56) References Cited

U.S. PATENT DOCUMENTS 1,721,192 A * 7/1929 Tarbox ..... 40/583
4,033,672 A * 7/1977 Dalmasso ..... 349/62
4,268,985 A * 5/1981 Lecznar ..... 40/219
4,381,616 A * 5/1983 Saxer ..... 40/502
4,988,986 A * 1/1991 Martin ..... 340/815.73
6,491,219 B2 12/2002 Brentini

FOREIGN PATENT DOCUMENTS

FR 2 843 224 2/2004

* cited by examiner

*Primary Examiner*—Lesley Morris
*Assistant Examiner*—Kristina Staley
(74) *Attorney, Agent, or Firm*—Moetteli & Associés SàRL

(57) ABSTRACT

A modular indicator of information relating to an article on display is provided. The indicator is made up of a plurality of display units which can be fixed each to the following other along a longitudinal axis of composition. Each display unit is made of a material translucent to light and configured in a substantially prismatic shape to gather incident tight into a first surface and reflect the incident light toward a front face of the display unit of a second surface in a direction substantially perpendicular to said front face.

13 Claims, 6 Drawing Sheets

BACK-LIGHTED PRISMATIC MODULE PRICE DISPLAY SYSTEM

CROSS REFERENCE TO RELATED APPLICATIONS

This application claims priority to U.S. Provisional application Ser. No. 60/743,781, of the same title, filed Mar. 26, 2006, the content of which is incorporated herein by reference thereto.

FIELD OF THE INVENTION

The present invention is in the field of pricing displays. More specifically, the present invention relates to a back-lighted, prismatic module price display system.

BACKGROUND OF THE INVENTION

A type of modular price indicator currently available commercially, with reference in particular to the sector of luxury items or valuable goods, such as for example gold articles or timepieces, is formed by a plurality of plastic cubes. In use, these cube indicators of the prior art are fixed each to the other along a longitudinal axis, with each cube having an alphanumeric character pressed in a coplanar manner into its surface, or in a raised plane on the display face of the cube. Several such cubes can be arranged together to form an indicator representing a price or other information relevant to an article. Such an indicator is typically placed near an article within a display space that is advantageously lighted and decorated to attract attention and to enhance the visibility and appeal of the article. Cubes of relatively small size are preferred to avoid distracting attention from small size luxury items, such as jewelry. To achieve visibility of the price or model information, despite the relatively small display area offered by the modular price indicator, only highly contrasting colors are used for the alphanumerical characters and the background surface of the cube respectively (e.g., black on white, or white on black background). Price cubes with contrasting white or black colors do not harmonize well with more colorful display spaces and articles, and can limit the range of visual effects possible for such indicators, for example, in most cases, such displays offer so few color options that they most often do not match the alphanumeric characters' color with a dominant color of the article or display backdrop.

U.S. Pat. No. 6,491,219 to Brentini discloses a modular price indicator wherein the display units comprise a support mount and an alphanumerical segment cantilevered on the support mount. The alphanumeric characters of such display units are not displayed over a background and often provide a reduced visibility, for example, when such a price indicator is placed over a multi-colored surface or within an ornamented display. Reduced visibility is traditionally compensated for through use of display units of relatively larger size compared to the size of a typical, more discretely sized price cube. However, a larger size defies a desirable feature of a price indicator, namely that of providing clearly visible information while harmonizing with the article on display while having a limited visual footprint.

Therefore, what is needed is a price indicator system which provides clearly visible pricing information, and which can be easily harmonized with a variety of display environments and decorum, and which provides alphanumeric characters having a wide range of color without detrimentally altering visibility.

French Pat. No. 2843224 to Pulfer attempts to achieve this result by means of a back-lighted indicator for display purposes which features at least one zone that is transparent to light and that can be configured to display alphanumeric information related to an article. Such an indicator, typically having a rectangular shape, requires the use of a mirror at the back of the front plane of the indicator as to reflect incident lighting toward a direction substantially perpendicular to the front plane of the indicator. Such an indicator is expensive to produce, and not being modular, it is not configurable by the user to display information which is subject to change, such as are prices.

What is therefore needed is a light transmitting modular price indicator system which provides clearly visible pricing information, in a wide range of colors which may be easily harmonized with a variety of display environments and decorum without detrimentally altering visibility.

SUMMARY OF THE INVENTION

Figure 1A:
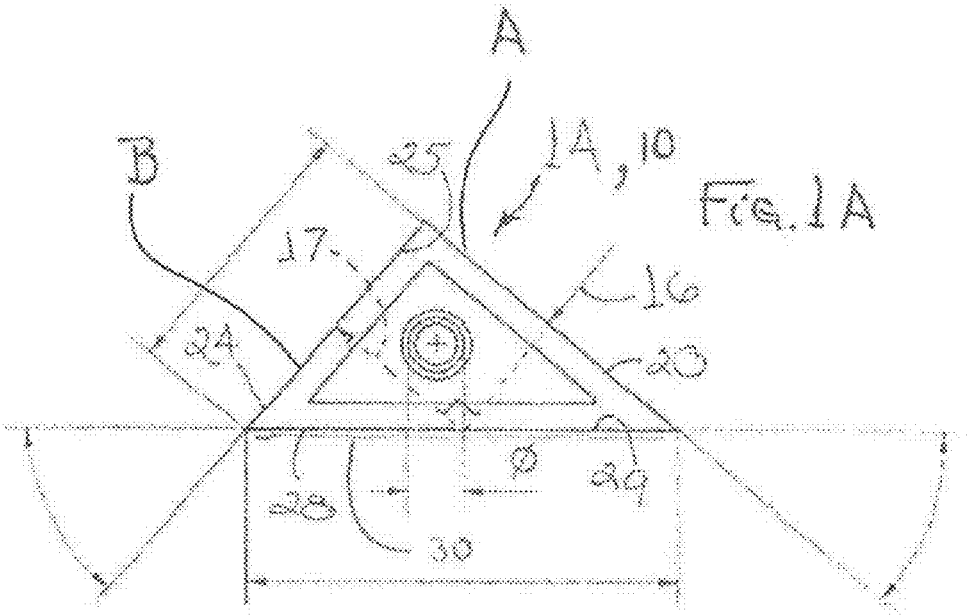
FIG. 1A is a side plan view of a pentagonal module display unit of the present invention from the "plug" side.

A prismatic module display system is provided for displaying pricing and other information. The system is a plurality of interconnecting display units which can be fixed each to the other along a longitudinal axis in order to provide an alphanumeric composition to be displayed. Each interconnecting display unit is made of a material translucent or transparent to light and provides backlighting of its alphanumeric character(s) by reflecting incident light toward a direction sensibly perpendicular to the front part of such display unit.

In this way, an object of the system, that of the display of information related to a luxury article, is accomplished in a manner which offers enhanced visibility of information. The system permits display of alphanumerical characters of a wide range of colors without detrimentally altering visibility of information.

It is another particular object of the present invention to provide a modular price offering a reduced visual footprint, such that alphanumerical information ideally appears on a neutral background that harmonizes with the color or texture of any display space or surface.

It is an object of the invention to provide a modular indicator with backlighting capabilities that is easy to handle, and which allows precise, practical and rapid assembly.

It is another object of the invention to provide an information display system for displaying information related to an article using back lighted information, that is easy to handle and which allows precise, practical and rapid assembly and which indicator harmonizes with any display space or surface.

DESCRIPTION OF THE INVENTION

Referring now to the drawings, the details of preferred embodiments of the present invention are graphically and schematically illustrated. Like elements in the drawings are represented by like numbers, and any similar elements are represented by like numbers with a different lower case letter suffix.

The present invention is a back-lightable, modular price display system 10. The modular display system 10 is useful for visually displaying information 12 relating to an article on display. As illustrated in the FIGS. 1A to 1C, the display system 10 comprises a plurality of individual interlocking display units 14 which can be fixed to each other in a series along a common longitudinal axis 18 to linearly display an alphanumeric composition for viewing. In the preferred embodiment, each modular display unit 14 is solid and made of a material translucent to light. The individual display units 14 are pentagonal (i.e., having 5 surfaces) and configured in a prism shape, i.e., a triangular prism. The purpose of the prism shape is to pass light 16 incident on a back face 20 through the interior of the prism and reflect the light off of the inner face 29 of the bottom surface 28 and direct the reflected light 17 toward the front face 24 of the display unit 14 in a direction substantially perpendicular to the front face 24.

Figure 5A:
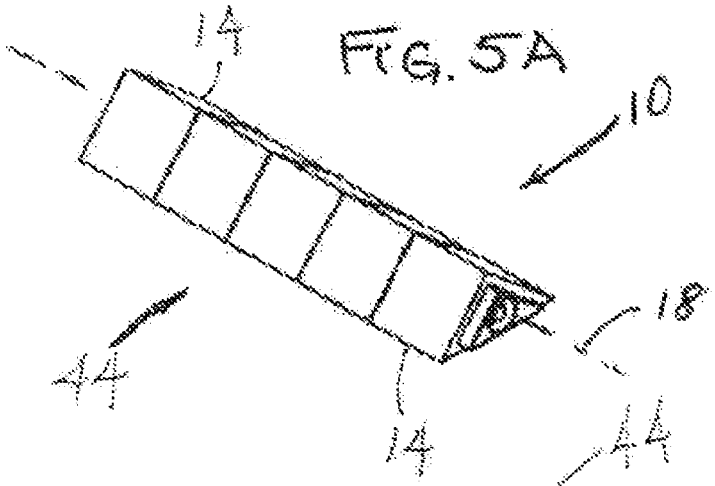
FIGS. 5A, 5B, 5C and 5D respectively are perspective, plug-side, top, and bottom views of an assembly of pentagonal module display units of the present display system.
Figure 5B:
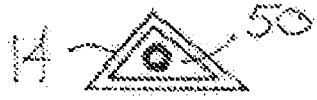
Figure 5C:
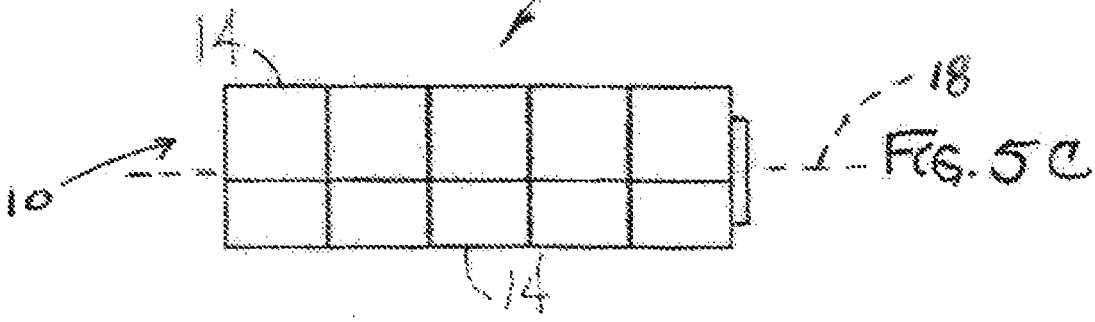
Figure 5D:
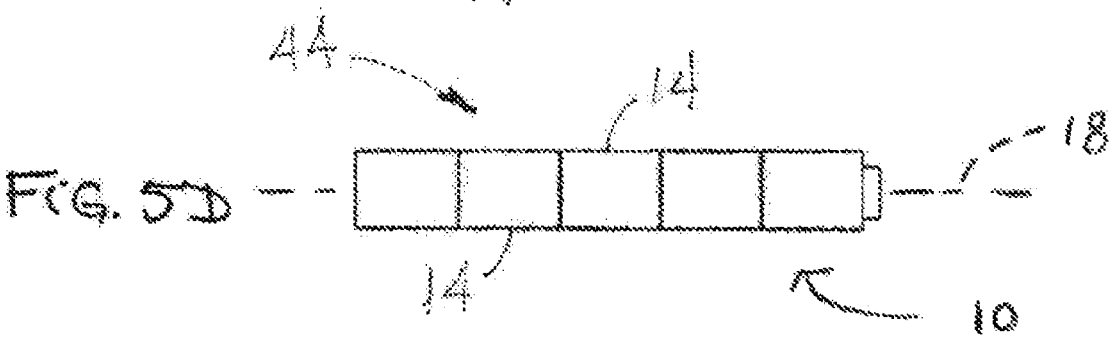
Figure 7:
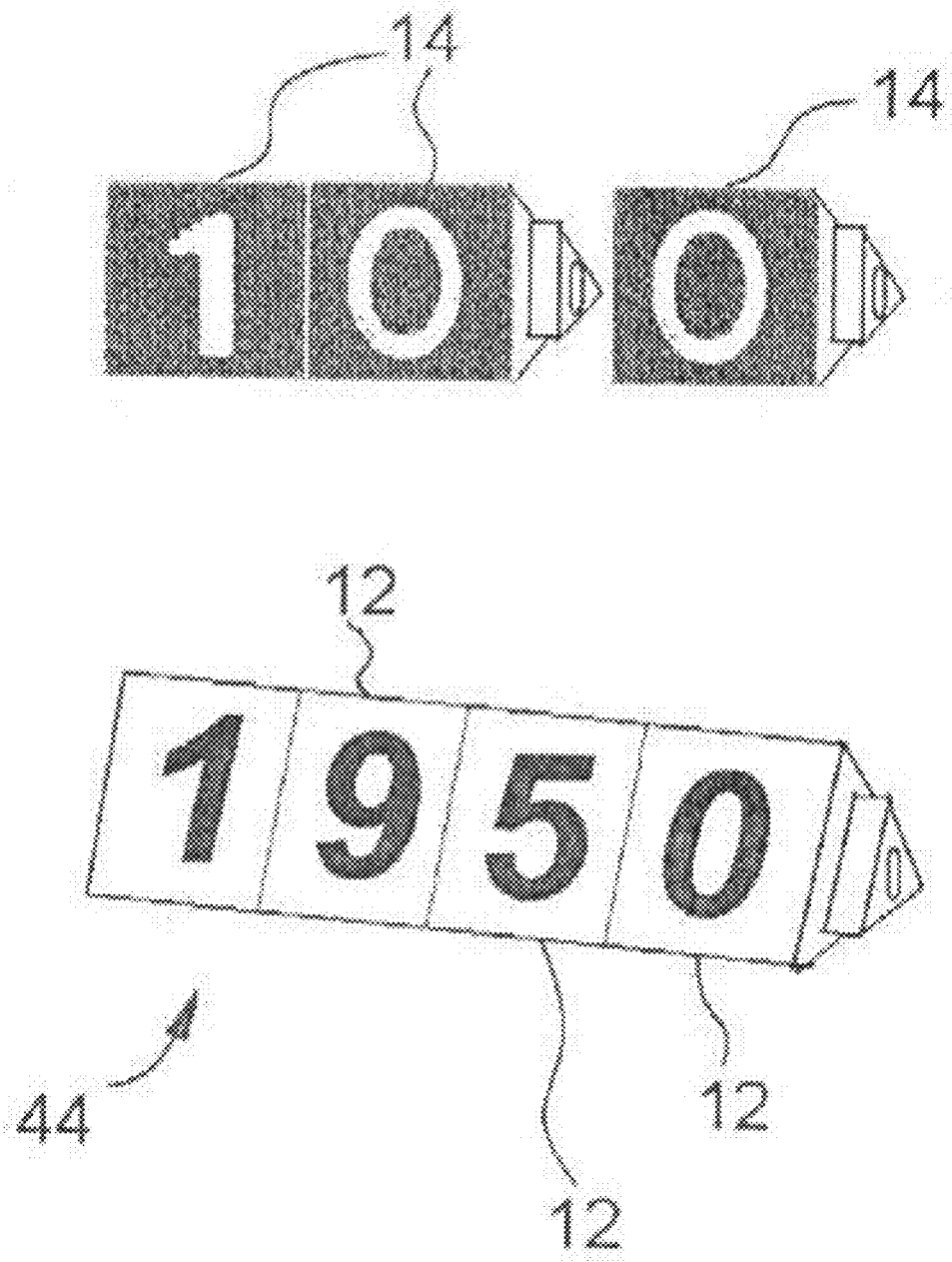
FIG. 7 is a photographic display of two assemblies of pentagonal module display units of the present display system.
Figure 8A:
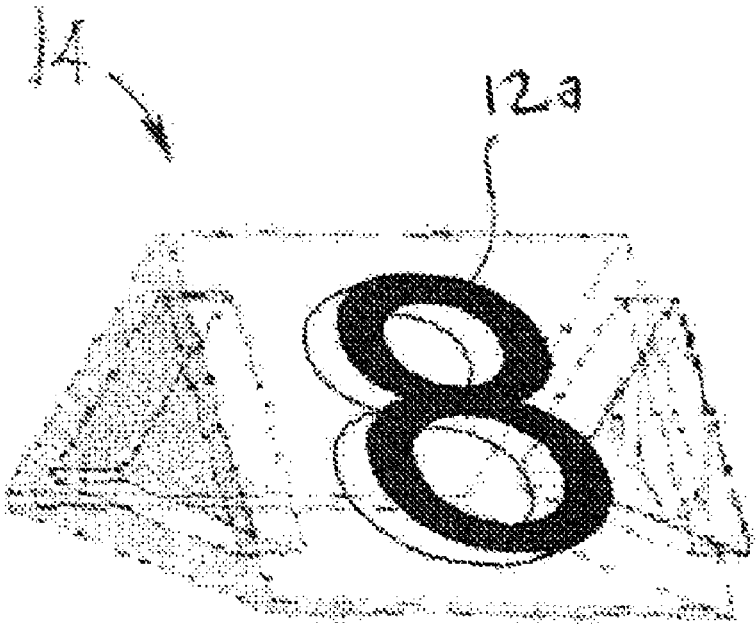
FIGS. 8A and 8B are perspective views of display module units of the present display system wherein one unit (A) has a raised alphanumeric character embossed on the display face and the other (B) has a recessed alphanumeric character set into the display face.
Figure 8B:
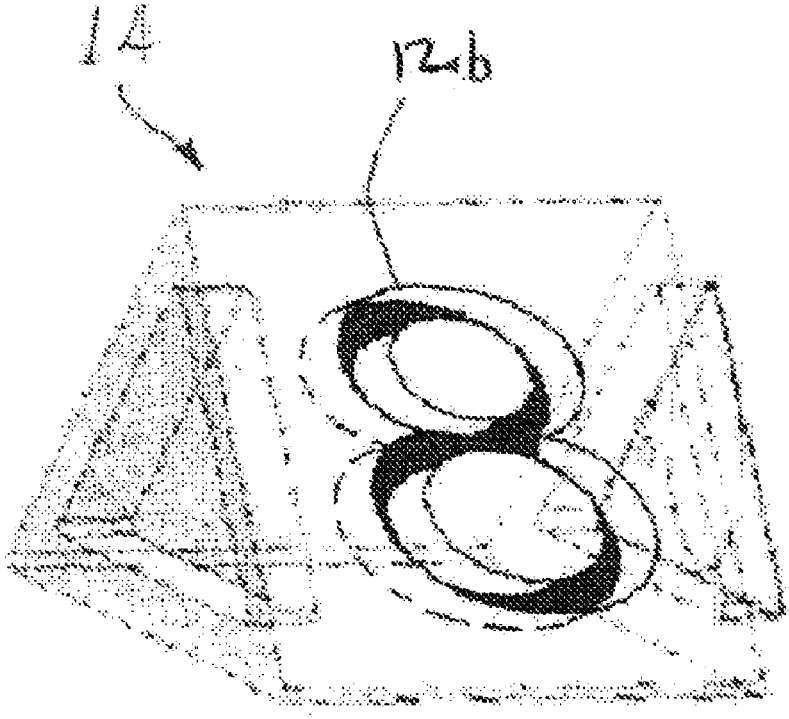

According to a first embodiment, the modular interconnecting display units 14 of the present back-lighted modular display system 10 are made of a translucent or transparent plastic or other material transparent to light. Such interconnecting display units as practicable in the present invention can be produced by injection molding using processes well known in the art. Each interconnecting display unit 14 has five surfaces: a front or display face 24, a back face 20, a bottom face 28, a plug side 32, and a receptacle side 36. The front or display face 24 of each display unit 14 supports or displays an alphanumeric character 12 for viewing. The alphanumeric character 12 can be can be any such character as is desired by the user and can be disposed on the display face 24 in any of a number of ways known to and selectable by one of skill in this art for practice in the present invention. For example, the alphanumeric character 12 can be printed onto the display face 24 (see FIG. 7); or they can be engraved, embossed, pressed/set into the face characters 12*b* (see FIG. 8B); and/or they can be set in a raised plane characters 12*a* (see FIGS. 8A). The use of a translucent material for the interlocking display units 14 provides a minimal visual footprint for the display unit 14 and reduces the visual impact of the surface area of the supporting display face 24 which does not convey information. This feature facilitates harmonizing an assembly 44 (e.g., see FIG. 5A and FIG. 7) of interconnecting display units 14 to any color or texture of the display space, surface and background.

Figure 1B:
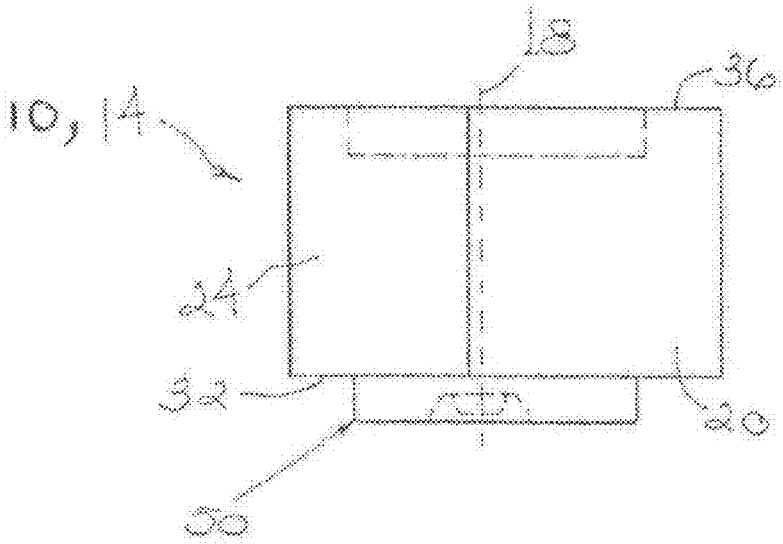
FIG. 1B is a top plan view of a pentagonal module display unit of the present invention showing the receptacle feature in phantom on the receptacle side of the display unit, and the plug feature extending from the plug side of the display unit.
Figure 1C:
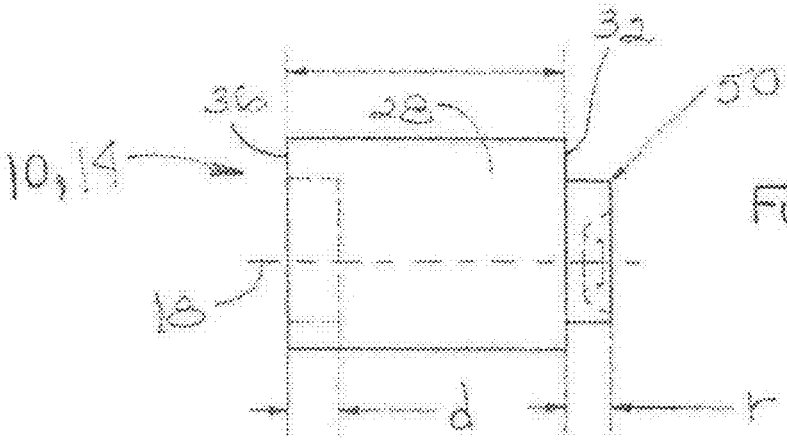
FIG. 1C is a bottom plan view of a present pentagonal module display unit showing the receptacle feature in phantom on the receptacle side of the display unit, and the plug feature extending from the plug side of the display unit.
Figure 2:
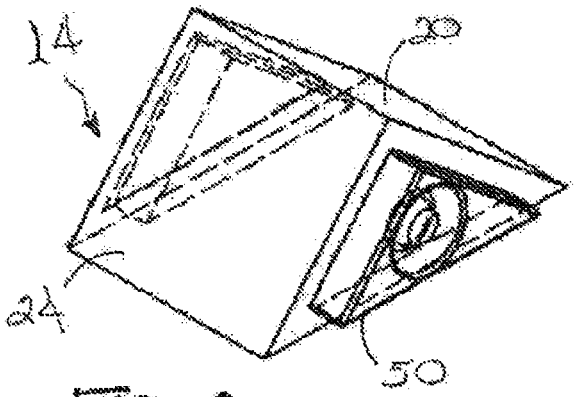
FIG. 2 is a perspective view of a present pentagonal module display unit showing the receptacle feature in phantom on the receptacle side of the display unit, and the plug feature extending from the plug side of the display unit.
Figure 3A:
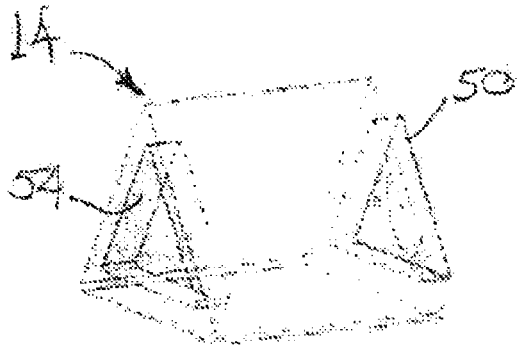
FIGS. 3A, 3B and 3C respectively are perspective, bottom and top views of a present pentagonal module display unit constructed of a transparent or translucent material.
Figure 3B:
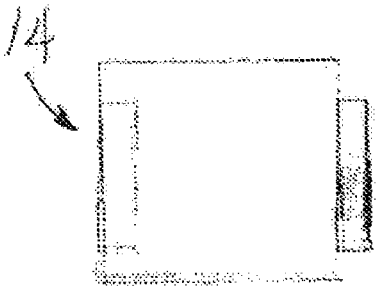
Figure 3C:
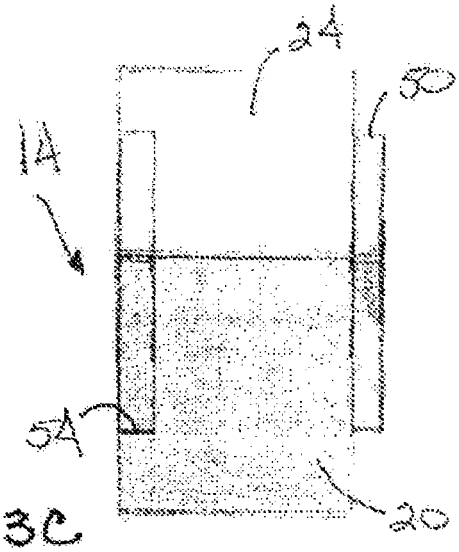
Figure 4A:
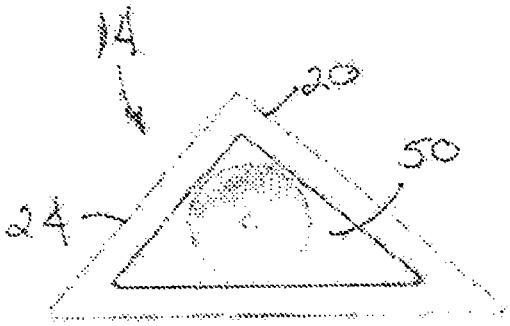
FIGS. 4A and 4B are plan views of the (A) plug side and the (B) receptacle side of a present pentagonal module display unit showing.
Figure 4B:
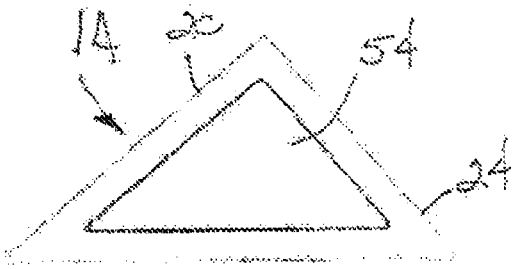

In the preferred embodiment of the display system 10 shown in FIG. 1A, each interconnecting display unit 14 is a monolithic structure, configured with a prism shape cross-section (e.g., a pentahedron or five-face polyhedron), and has the light reflecting characteristics of an optical prism. More specifically, the display units 14 form a prismatic light guide wherein the back surface 20 is an entry face for incident light 16 and the display surface 24 is an exit face for reflected light. The angular cross-section of the display units 14 is chosen so that light 16 incident on and transmitted through the back face 20 is substantially reflected off of inner-side 29 of the bottom face 28 inside the display unit 14 toward the inner-side 25 the display face 24. To enhance reflectivity, the inner-side 29 is smooth, polished and optionally, includes a reflective film adhered thereto. A suitable reflective film includes "MYLAR", a well known brand of reflective thin polyester film. The reflected light impinges on the display face 24 from a substantially perpendicular direction from the inner-side 25 of the display face 24, and passes through the display face 24 to provide for back-lighting for the alphanumeric characters 12 supported on the display face 24 due in large part to the fact that surface 20 is greater than surface 24, whereby the larger amount of collected light is reflected and intensified for projection on a small surface 24, the light entering in surface 20 is intensified. To capture this reflected light, the display surface may optionally be treated to make such surface surrounding the alphanumeric character 12 translucent and thus more absorbent of light, being illuminated by the reflected light.

The features of this embodiment enable an interlocking display unit 14 to use the ambient light available in the display space as a light source for backlighting the price or other information relevant to an article that is displayed on an assembly 44 of interconnecting display units 14. Because the alphanumeric characters 12 are lighted from behind, information displayed using alphanumerical characters on the front face of the display units 14 are presented with greater contrast and therefore highlighted. This makes the information much more visible, the back-lighted information "detaching" itself from the background surface, which is reflecting less light than if the information was directly illuminated from the front from a coherent direction. Backlighting also provides sufficient contrast to any color, so that the alphanumeric characters 12 can be provided in the color best fitting the associated article.

As illustrated in FIG. 2 to FIG. 4B, each interconnecting display unit 14 has a side with a projecting part or plug 50, and a parallel side with a recessed portion or receptacle. The plug 50 on the plug-side 32 of a display unit 14 is disposed to be received in the receptacle 54 on the receptacle-side 36. The engagement of the respective plug 50 and receptacle 54 of adjacent interlocking display units 14 is accomplished along a common longitudinal axis 18. This feature provides an inline assembly 4 of adjacent interlocking display units 14 having a linear alphanumeric character display of information dependent on the user's choice of constituent individual display module units 14.

In a preferred embodiment, the plug 50 and the receptacle 54 of an interlocking display unit 14 have a triangular cross-section along the common axis 18. In the embodiment illustrated, the triangular cross-section is congruent with the cross-section of the display unit 14 as a whole, but this is not necessary. In fact, a single plug 50 and receptacle 54 may be replaced with a small bosses (not shown) that interface with corresponding recesses (not shown) formed to snap-fit together. Nevertheless, in the embodiment shown, the plug 50 and the receptacle 54 respectively should have minimum reach r and depth d dimensions along the longitudinal axis 18. This limitation optimizes the contact surface between the recessed and projecting parts of the display units 14, while minimizing the loss of light due to scattering caused by the engagement of the projecting part into next display unit's recessed part.

Of course, a user does not have to rely only on ambient light as the source of light 16 incident back surface 20 of a display unit 14. A user can provide an auxiliary light source (not shown) trained on the back surfaces 20 of the present display 10. A benefit of this is that the auxiliary light source can be somewhat remote from the article being displayed and therefore interfere less with the esthetics of the overall display.

Figure 6A:
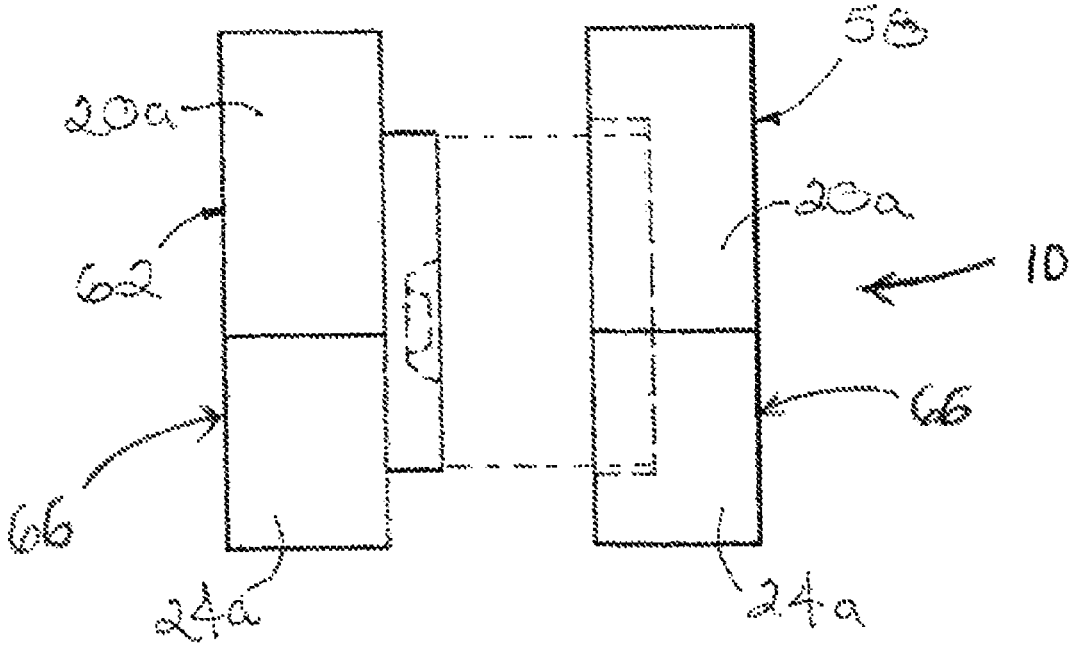
FIGS. 6A and 6B respectively are top and front plan views each of a pair of end-caps useful for initiating and/or terminating an assembly of interconnecting module display units of the present display system.
Figure 6B:
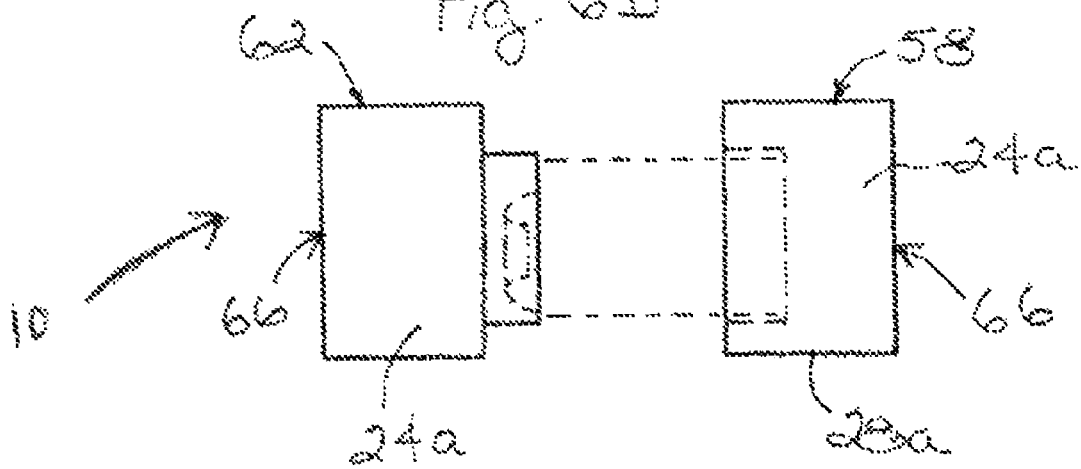

In another preferred embodiment illustrated in FIGS. 6A and 6B, the present display system 10 includes end-cap units useful for initiating and/or terminating an assembly 44 of interconnecting display units of the present display system 10. There are two types of end-cap units. One is a plug-cap 58 for terminating a plug-side 32 of a display unit assembly 44, and the other is a receptacle-cap 62 for terminating receptacle-side 36. The end-cap units 58 and 62 each has one plain-side 66. The display face 24*a*, back face 20*a*, bottom face 28*a* and plain-side 66 of the end-cap units 58 and 62 do not have to pass or reflect light, and in some cases, the esthetics of an application may benefit from having these surfaces opaque and/or colored.

In another preferred embodiment, the present back-lighted modular display system is provided as a kit, with a selection of individual interlocking display units 14 having a variety of alphanumeric characters 12 displayed on them, and the displayed characters in a variety of colors and styles, and in at selection of background colors. In this embodiment, the various components of the present invention are provided in a container for storing and for presenting the unit parts for easy incorporation into a modular assembly 44.

Other objects, advantages and features of the present invention will become more apparent upon reading the following non-restrictive description of preferred embodiments thereof, given by way of example only with reference to the accompanying drawings.

Multiple variations and modifications are possible in the embodiments of the invention described here. Although certain illustrative embodiments of the invention have been shown and described here, a wide range of modifications, changes, and substitutions is contemplated in the foregoing disclosure. In some instances, some features of the present invention may be employed without a corresponding use of the other features. Accordingly, it is appropriate that the foregoing description be construed broadly and understood as being given by way of illustration and example only, the spirit and scope of the invention being limited only by the appended claims. While the above description contains many specifics, these should not be construed as limitation's on the scope of the invention, but rather as exemplifications of one or another preferred embodiment thereof. Accordingly, the scope of the invention should be determined by the scope of the appended claims and their equivalents, and not just by the embodiments.

What is claimed is:

1. A modular indicator of information relating to an article on display, the indicator being a passive indicator using only ambient light for illumination, and wherein information indicated thereby being expandable by connecting together a plurality of such display units which are adapted to be fixed to one another along a longitudinal, composition axis, wherein each display unit is monolithic in that the display unit integrates therein a prism on which a face of the prism comprises at least a portion of the information to be indicated, such information being integrated directly onto the face of the prism, the display unit further being made of a material substantially transparent to light and configured in a substantially prismatic shape to gather incident light into a first surface of size A and reflect the incident light toward a front face of the same display unit, the front face having a surface of size B in a direction substantially perpendicular to said front face, wherein further, the front face of the display unit is treated so as to be translucent in order to absorb reflected light.

2. The indicator of claim 1, wherein A is greater than B.

3. The indicator of claim 1, wherein A is substantially the same as B.

4. The indicator of claim 1, wherein a surface which reflects the incident light is a highly reflective surface which maximizes an amount of light reflected thereby.

5. The indicator of claim 4, wherein a reflective thin polyester film is adhered to the reflective surface to improve the reflectivity of the reflective surface.

6. A modular indicator according to claim 1, wherein each display unit is made of injected plastic material.

7. A modular indicator according to claim 1, wherein each display unit displays one alphanumerical character.

8. A modular indicator according to claim 1, wherein an alphanumerical character is pressed coplanarly on said display unit front face.

9. A modular indicator according to claim 1, wherein an alphanumerical character is pressed on a raised plane on said display unit front plane.

10. A modular indicator according to claim 1, wherein an alphanumerical character is pressed on a recessed plane on said display unit front plane.

11. A modular indicator according to claim 1, wherein each display unit comprises a projecting part formed in one part with the body part, and a recessed part formed in one single part with the body part is adapted to engage with the projecting part of an adjacent display unit along the longitudinal axis of the modular indicator.

12. A modular indicator assembly for displaying information related to an article, comprises a plurality of modular indicators passively transmitting ambient light are fixed to adjacent modular indicators along a longitudinal axis of composition for the modular indicator assembly, wherein each modular indicator is monolithic in that the display unit integrates therein a prism on which a face of the prism comprises at least a portion of the information to be indicated, such information being integrated directly onto the face of the prism, the display unit further being made of a material substantially transparent to light and configured in a prism shape reflecting incident, ambient light emitted by the light source substantially in a vertical direction to the said modular indicator, to a direction substantially perpendicular to the front face of said modular indicator, wherein further, the display space of each modular indicator is treated so as to be translucent in order to absorb reflected light.

13. A modular indicator of information relating to an article on display comprising a plurality of display units which can be fixed each to the following other along a longitudinal axis of composition for the modular indicator, wherein each display unit is monolithic in that the display unit integrates therein a prism on which a face of the prism comprises at least a portion of the information to be indicated, such information being integrated directly onto the face of the prism, the display unit further being made of a material substantially transparent to light and configured in a substantially prismatic shape to gather incident light into a first surface of size A and reflect the incident light toward a front face of the same display unit, the front face having a surface of size B in a direction substantially perpendicular to said front face and wherein the surface of size B is treated to be translucent to light so as to absorb the light reflected thereagainst.

* * * * *

UNITED STATES PATENT AND TRADEMARK OFFICE

CERTIFICATE OF CORRECTION

PATENT NO. : 7,810,263 B2
APPLICATION NO. : 11/676556
DATED : October 12, 2010
INVENTOR(S) : Louis Demaurex It is certified that error appears in the above-identified patent and that said Letters Patent is hereby corrected as shown below:

Title page, item [57], abstract line 6, replace the phrase "to gather incident tight into a" with --to gather incident light into a--.

In Col. 2, line 59, replace the phrase "A prismatic module" with --A translucent prismatic module--.

In Col. 5, line 36, replace the phrase ", and in at" with --, and in a--.

In Col. 5, line 58, replace the phrase "as limitation's on the scope of" with --as limitations on the scope of--.

Signed and Sealed this
Twenty-eighth Day of December, 2010

David J. Kappos

David J. Kappos
*Director of the United States Patent and Trademark Office*